US011022346B2

(12) United States Patent
Sun et al.

(10) Patent No.: US 11,022,346 B2
(45) Date of Patent: Jun. 1, 2021

(54) METHOD FOR DETECTING A LOSS OF REFRIGERANT CHARGE OF A REFRIGERATION SYSTEM

(71) Applicant: Carrier Corporation, Palm Beach Gardens, FL (US)

(72) Inventors: Jian Sun, Fayetteville, NY (US); Lucy Yi Liu, Fayetteville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 169 days.

(21) Appl. No.: 15/776,417

(22) PCT Filed: Nov. 17, 2016

(86) PCT No.: PCT/US2016/062458

§ 371 (c)(1),
(2) Date: May 16, 2018

(87) PCT Pub. No.: WO2017/087628

PCT Pub. Date: May 26, 2017

(65) Prior Publication Data

US 2018/0328628 A1 Nov. 15, 2018

Related U.S. Application Data

(60) Provisional application No. 62/256,557, filed on Nov. 17, 2015.

(51) Int. Cl.

| | |
|---|---|
| ***F25B 9/00*** | (2006.01) |
| ***F25B 1/10*** | (2006.01) |
| ***F25B 49/02*** | (2006.01) |

(52) U.S. Cl.

CPC ..... *F25B 9/008* (2013.01); *F25B 1/10* (2013.01); *F25B 49/02* (2013.01);
(Continued)

(58) Field of Classification Search

CPC ..... F25B 9/008; F25B 2700/2104; F25B 2313/0314; F25B 2700/2106; F25B 2500/222; F25B 2313/0315

See application file for complete search history.

(56) References Cited

U.S. PATENT DOCUMENTS 4,395,886 A 8/1983 Mayer
4,722,019 A 1/1988 Pohl
(Continued)

FOREIGN PATENT DOCUMENTS

CN 1890516 A 1/2007
CN 101578487 A 11/2009
(Continued)

OTHER PUBLICATIONS

Matsushita, Coolant Leakage Detecting Method, Coolant Leakage Detector and Air Conditioner, Mar. 13, 2008, JP2008057837A, Whole Document (Year: 2008).*
(Continued)

*Primary Examiner* — Larry L Furdge
(74) *Attorney, Agent, or Firm* — Cantor Colburn LLP

(57) ABSTRACT

A method of determining charge loss of a refrigeration system includes the steps of inputting an ambient temperature, a box temperature, and a compressor speed into an electronic controller of the refrigeration system, and calculating a first air side temperature difference across an evaporator by applying an algorithm having a first T-Map representative of normal operating conditions. The controller may then confirm a detection prerequisite is satisfied. Upon confirmation, the controller calculates a second air side temperature difference across the evaporator by applying the algorithm having a second T-Map representative of a loss of refrigerant charge. An action may then be taken from the
(Continued)

controller if the first air side temperature difference is less than the second air side temperature difference.

15 Claims, 4 Drawing Sheets

(52) U.S. Cl.
CPC ..... *F25B 2313/0314* (2013.01); *F25B 2313/0315* (2013.01); *F25B 2400/13* (2013.01); *F25B 2500/222* (2013.01); *F25B 2700/171* (2013.01); *F25B 2700/2104* (2013.01); *F25B 2700/2106* (2013.01)

(56) References Cited

U.S. PATENT DOCUMENTS

| | | | | |
|---|---|---|---|---|
| 4,949,550 | A | 8/1990 | Hanson | |
| 5,150,584 | A | 9/1992 | Tomosov et al. | |
| 5,251,453 | A | 10/1993 | Stanke et al. | |
| 5,713,213 | A | 2/1998 | Nobuta et al. | |
| 5,934,087 | A | 8/1999 | Watanabe et al. | |
| 6,330,802 | B1 | 12/2001 | Cummings et al. | |
| 6,425,253 | B1 | 7/2002 | Gale et al. | |
| 6,446,505 | B1 | 9/2002 | Wieszt et al. | |
| 6,508,067 | B2 | 7/2003 | Liu et al. | |
| 6,840,053 | B2 | 1/2005 | Lindner et al. | |
| 6,868,678 | B2 | 3/2005 | Mei et al. | |
| 8,100,167 | B2 | 1/2012 | Thyro et al. | |
| 8,830,079 | B2 | 9/2014 | Smith et al. | |
| 2002/0139128 | A1 | 10/2002 | Suzuki et al. | |
| 2005/0039469 | A1* | 2/2005 | Nonaka | F25B 49/005 62/129 |
| 2005/0056031 | A1 | 3/2005 | Jeong | |
| 2005/0086952 | A1* | 4/2005 | Nonaka | F25B 49/005 62/129 |
| 2005/0109050 | A1 | 5/2005 | Laboe et al. | |
| 2005/0126190 | A1 | 6/2005 | Lifson et al. | |
| 2005/0126191 | A1 | 6/2005 | Lifson et al. | |
| 2013/0002446 | A1 | 1/2013 | Smith et al. | |
| 2013/0160470 | A1* | 6/2013 | Schuster | F25B 45/00 62/77 |
| 2015/0007591 | A1 | 1/2015 | Liu et al. | |

FOREIGN PATENT DOCUMENTS

| | | | |
|---|---|---|---|
| CN | 202431490 | A | 9/2012 |
| DE | 60119765 | T2 | 10/2006 |
| DE | 10200701452 | A1 | 7/2008 |
| GB | 1564190 | A | 4/1980 |
| JP | 2003090654 | A | 3/2003 |
| JP | 2003139446 | A | 5/2003 |
| JP | 2005257219 | A | 9/2005 |
| JP | 2006112698 | A | 4/2006 |
| JP | 2008057837 | A * | 3/2008 |

OTHER PUBLICATIONS

Liu et al., Method for Detection of Loss of Refrigerant, Aug. 5, 2013, WO2013119489A2, Whole Document (Year: 2013).*
International Search Report from the International Searching Authority for International Application No. PCT/US2016/062458; Date of Completion: Feb. 9, 2017; dated Feb. 22, 2017; 5 Pages.
Written Opinion from the International Searching Authority for International Application No. PCT/US2016/062458; International Filing Date: Nov. 17, 2016; dated Feb. 22, 2017; 6 Pages.
Search Report for Application No. 11201803484Q dated Sep. 12, 2019; 2 pages.
Written Opinion for Application No. 11201803484Q dated Sep. 12, 2019; 7 pages.
Chinese Office Action for Chinese Appication No. 201680069300.2; dated Dec. 25, 2019; 6 Pages.
Notice of Reasons for Rejection for Japanese Application No. 2018525460; dated Oct. 13, 2020; 3 Pages.
Notice of Reasons for Rejection for Japanese Application No. 2018525460; dated Oct. 13, 2020; 3 Pages; English Translation.

* cited by examiner

| T-MAP-NORMAL | FRQ_MAX Hz | FREQ_1 Hz | FREQ_2 Hz | FREQ_MIN Hz |
|---|---|---|---|---|
| a0 | 8.461409 | 5.596432 | 2.34862 | 1.044997 |
| a1 | 0.048871 | 0.023701 | -0.04616 | -0.0183 |
| a2 | 0.132713 | 0.077203 | 0.059483 | 0.021654 |
| a3 | -0.00253 | -0.00158 | 0.00071 | 0.000305 |
| a4 | 0.000614 | 0.000845 | 0.000561 | 0.000254 |
| a5 | 0.00021 | 0.000749 | -0.00058 | -2.4E-05 |
| T-MAP-CHARGELOSS | | | | |
| a0 | 6.715048 | 4.192638 | 1.481675 | 0.982807 |
| a1 | -0.04093 | -0.04334 | 0.020861 | 0 |
| a2 | 0.127418 | 0.073604 | 0.112409 | 0.009985 |
| a3 | -0.00063 | 5.68E-05 | -0.00064 | -0.00027 |
| a4 | -6.1E-05 | -0.00023 | -0.00043 | -8.7E-05 |
| a5 | -0.00187 | -0.00094 | -0.00237 | -1.1E-05 |

FIG. 3

METHOD FOR DETECTING A LOSS OF REFRIGERANT CHARGE OF A REFRIGERATION SYSTEM

CROSS REFERENCE TO RELATED APPLICATIONS

This application is a National Stage application of PCT/US2016/062458, filed Nov. 17, 2016, which claims the benefit of U.S. Provisional Application No. 62/256,557, filed Nov. 17, 2015, both of which are incorporated by reference in their entirety herein.

BACKGROUND

The present disclosure relates to refrigeration systems and, more particularly, to a method of detecting a loss of refrigerant charge.

In a typical refrigeration system, a refrigerant flows through a compressor and exits at a high pressure. The pressurized refrigerant may then flow through a condenser where the refrigerant may condense from a vapor and into a liquid, thus dispensing heat. From the condenser, the refrigerant in liquid form flows through an expansion valve where it experiences a pressure drop. From the expansion valve the refrigerant flows through an evaporator where it draws heat from the evaporator and returns to a vapor form.

Different types of refrigeration systems may utilize different refrigerants and operate at different pressures. One type of system is a trancritical refrigeration system that may use CO2 as a refrigerant. Such systems typically operate at high pressures which may range from 1000 psia to 1800 psia. Unfortunately, the higher the operating pressure the higher may be the risk of a refrigerant leak. Moreover, all refrigeration systems are sensitive toward loss of refrigerant charge and may lose operating efficiency or cease operating altogether. Improvements in the detection of such a refrigerant charge loss is desirable.

SUMMARY

A method of determining charge loss of a refrigeration system including inputting a supply/return air temperature, ambient temperature, a box temperature, and a compressor speed into an electronic controller of the refrigeration system; calculating a real-time air side temperature difference across an evaporator; calculating a first air side temperature difference across the evaporator by applying an algorithm having a first T-Map representative of normal operating conditions; confirming a detection prerequisite is satisfied; calculating a second air side temperature difference across the evaporator by applying the algorithm having a second T-Map representative of a loss of refrigerant charge; taking an action if the real-time air side temperature difference is less than the first air side temperature difference; and taking an action if the real-time air side temperature difference is less than the second air side temperature difference.

Additionally to the foregoing embodiment, the method includes inputting an evaporator multi-speed fan speed.

In the alternative or additionally thereto, in the forgoing embodiment, the algorithm applies a polynomial.

In the alternative or additionally thereto, in the forgoing embodiment, the first and second T-Maps are pre-programmed into the controller and provide a curve fit of a plurality of constants versus compressor speed.

In the alternative or additionally thereto, in the forgoing embodiment, the plurality of constants are six constants applied to ambient temperature and box temperature variables as part of the polynomial.

In the alternative or additionally thereto, in the forgoing embodiment, the detection prerequisite is a measured compressor speed being greater than a predefined compressor speed.

In the alternative or additionally thereto, in the forgoing embodiment, the detection prerequisite is the first air side temperature difference being greater than a predefined temperature difference.

In the alternative or additionally thereto, in the forgoing embodiment, the detection prerequisite is that the first air side temperature difference is determined after a predefined time span from initial system startup and initial pulldown.

In the alternative or additionally thereto, in the forgoing embodiment, the detection prerequisite is one of a plurality of detection prerequisites and at least includes a measured compressor speed being greater than a predefined compressor speed, the first air side temperature difference being greater than a predefined temperature difference, and the first air side temperature difference is determined after a predefined time span from initial system startup and initial pulldown.

In the alternative or additionally thereto, in the forgoing embodiment, the first and second T-Maps are representative of evaporator air side temperature difference versus ambient temperature, box temperature, compressor speed and refrigerant charge.

In the alternative or additionally thereto, in the forgoing embodiment, the refrigeration system is a transcritical refrigeration system.

In the alternative or additionally thereto, in the forgoing embodiment, the method includes inputting an evaporator variable speed fan speed.

A refrigeration system according to another, non-limiting, embodiment includes an electronic controller including, pre-programmed first and second T-Maps both representative of evaporator air side temperature difference versus ambient temperature, box temperature, compressor speed and refrigerant charge operating conditions, and wherein the first T-Map is representative of normal operating conditions and the second T-Map is representative of a loss of refrigerant charge, and pre-programmed prerequisites configured to be met prior to initiating an action based on a loss of refrigerant charge; and wherein the electronic controller is configured to calculate first and second evaporator air side temperatures based on the respective first and second T-maps and initiates an action if the first air side temperature difference is less than the second air side temperature difference.

Additionally to the foregoing embodiment, the refrigeration system is a transcritical refrigeration system.

In the alternative or additionally thereto, in the forgoing embodiment, the refrigerant is CO2.

The foregoing features and elements may be combined in various combinations without exclusivity, unless expressly indicated otherwise. These features and elements as well as the operation thereof will become more apparent in light of the following description and the accompanying drawings. However, it should be understood that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows:

FIG. 3 is a table of T-Map Normal and T-Map Charge Loss data; and

DETAILED DESCRIPTION

Figure 1:
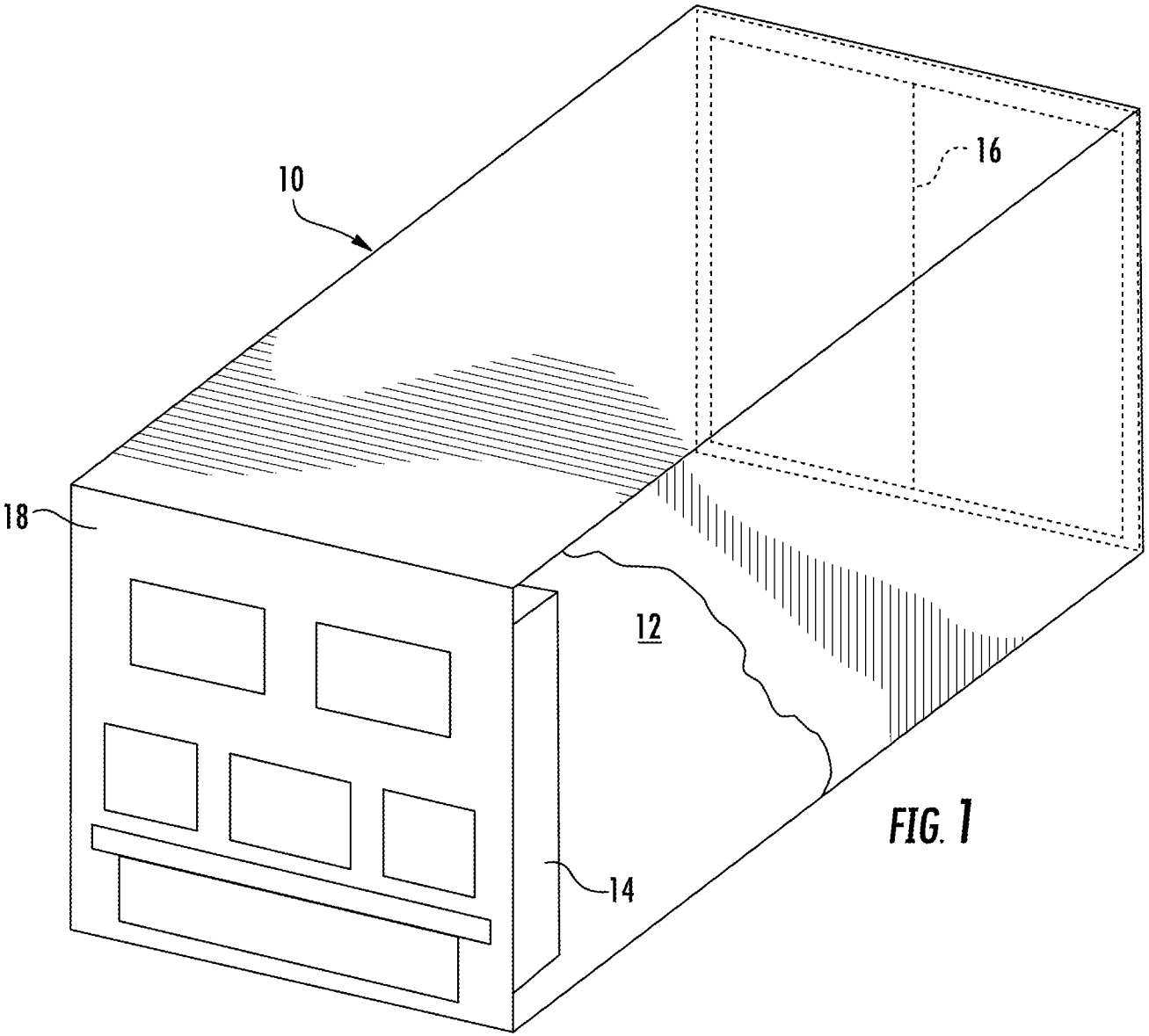
FIG. 1 is a perspective view of a refrigerated container utilizing a transport refrigeration unit as one, non-limiting, exemplary embodiment of the present disclosure.

Referring to FIG. 1, an exemplary embodiment of a refrigerated container 10 having a temperature controlled cargo space 12 the atmosphere of which is refrigerated by operation of a transport refrigeration unit 14 associated with the cargo space 12. In the depicted embodiment of the refrigerated container 10, the transport refrigeration unit 14 is mounted in a wall of the refrigerated container 10, typically in the front wall 18 in conventional practice. However, the refrigeration unit 14 may be mounted in the roof, floor or other walls of the refrigerated container 10. Additionally, the refrigerated container 10 has at least one access door 16 through which perishable goods, such as, for example, fresh or frozen food products, may be loaded into and removed from the cargo space 12 of the refrigerated container 10.

Figure 2:
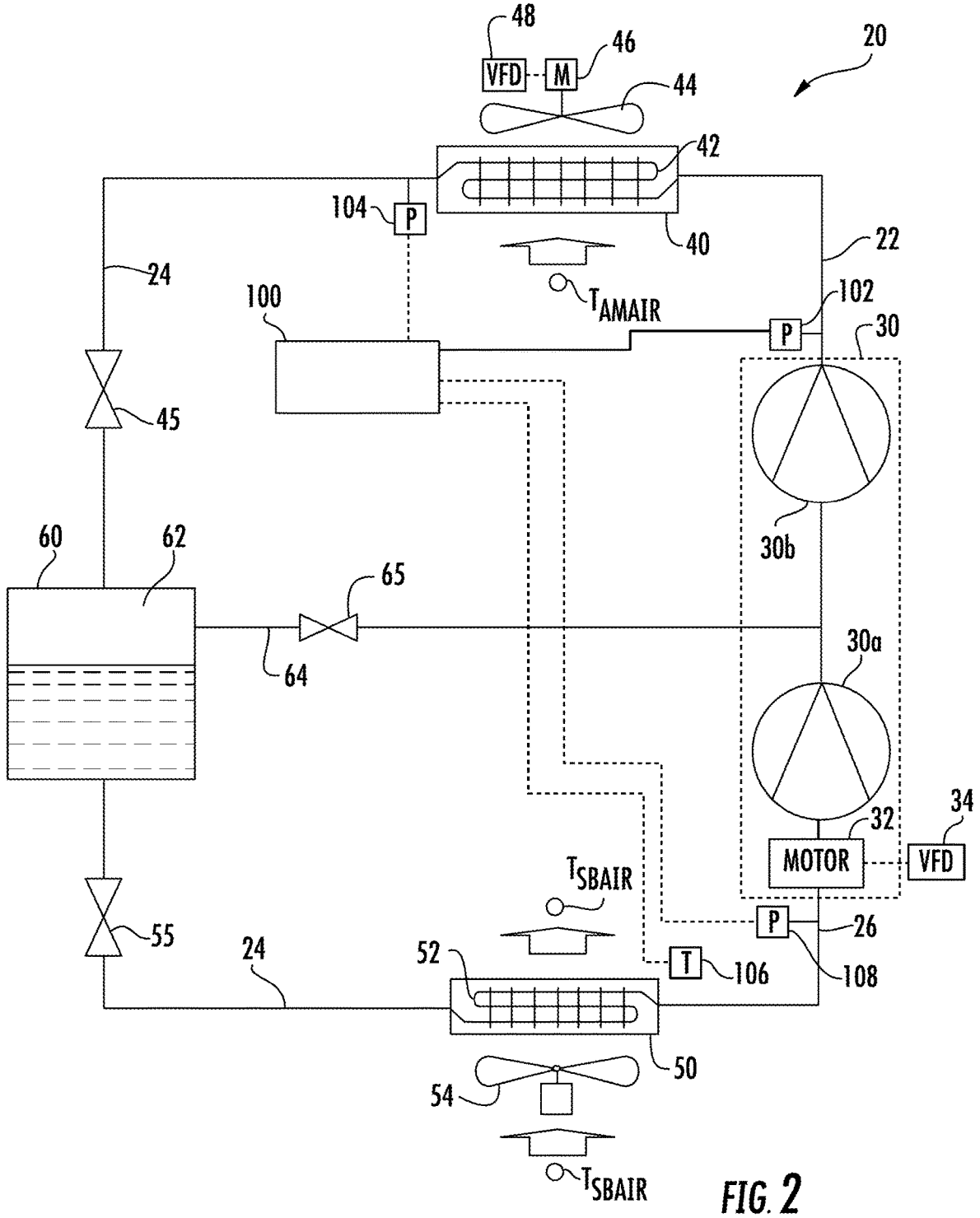
FIG. 2 is a schematic of a refrigeration system of the transport refrigeration unit.

Referring now to FIG. 2, there is depicted schematically an embodiment of a refrigeration system 20 suitable for use in the transport refrigeration unit 14 for refrigerating air drawn from and supplied back to the temperature controlled cargo space 12. Although the refrigeration system 20 will be described herein in connection with a refrigerated container 10 of the type commonly used for transporting perishable goods by ship, by rail, by land or intermodally, it is to be understood that the refrigeration system 20 may also be used in transport refrigeration units for refrigerating the cargo space of a truck, a trailer or the like for transporting perishable fresh or frozen goods. The refrigeration system 20 is also suitable for use in conditioning air to be supplied to a climate controlled comfort zone within a residence, office building, hospital, school, restaurant or other facility. The refrigeration system 20 could also be employed in refrigerating air supplied to display cases, merchandisers, freezer cabinets, cold rooms or other perishable and frozen product storage areas in commercial establishments.

The refrigeration system 20 may include a compressor 30 that may be multi-stage, a heat rejector 40 that may be a heat exchanger that rejects heat, a flash tank 60, an evaporator 50 that may be a heat exchanger that absorbs refrigerant heat, and refrigerant lines 22, 24 and 26 connecting the aforementioned components in serial refrigerant flow order in a primary refrigerant circuit. A high pressure expansion device (HPXV) 45, such as for example an electronic expansion valve, is disposed in refrigerant line 24 upstream of the flash tank 60 and downstream of the heat rejector 40. An evaporator expansion device (EVXV) 55, such as for example an electronic expansion valve, operatively associated with the evaporator 50, is disposed in refrigerant line 24 downstream of the flash tank 60 and upstream of the evaporator 50.

The compressor 30 functions to compress the refrigerant and to circulate refrigerant through the primary refrigerant circuit, and may be a single, multiple-stage refrigerant compressor (e.g., a reciprocating compressor or a scroll compressor) having a first compression stage 30*a* and a second stage 30*b*, wherein the refrigerant discharging from the first compression stage 30*a* passes to the second compression stage 30*b* for further compression. Alternatively, the compressor 30 may comprise a pair of individual compressors, one of which constitutes the first compression stage 30*a* and other of which constitutes the second compression stage 30*b*, connected in series refrigerant flow relationship in the primary refrigerant circuit via a refrigerant line connecting the discharge outlet port of the compressor constituting the first compression stage 30*a* in refrigerant flow communication with the suction inlet port of the compressor constituting the second compression stage 30*b* for further compression. In a two compressor embodiment, the compressors may be scroll compressors, screw compressors, reciprocating compressors, rotary compressors or any other type of compressor or a combination of any such compressors. In both embodiments, in the first compression stage 30*a*, the refrigerant vapor is compressed from a lower pressure to an intermediate pressure and in the second compression stage 30*b*, the refrigerant vapor is compressed from an intermediate pressure to higher pressure.

The compressor 30 may be driven by a variable speed motor 32 powered by electric current delivered through a variable frequency drive 34. The electric current may be supplied to the variable speed drive 34 from an external power source (not shown), such as for example a ship board power plant, or from a fuel-powered engine drawn generator unit, such as a diesel engine driven generator set, attached to the front of the container. The speed of the variable speed compressor 30 may be varied by varying the frequency of the current output by the variable frequency drive 34 to the compressor drive motor 32. It is to be understood, however, that the compressor 30 could in other embodiments comprise a fixed speed compressor.

The heat rejector 40 may comprise a finned tube heat exchanger 42 through which hot, high pressure refrigerant discharged from the second compression stage 30*b* (i.e. the final compression charge) passes in heat exchange relationship with a secondary fluid, most commonly ambient air drawn through the heat exchanger 42 by the fan(s) 44. The finned tube heat exchanger 42 may comprise, for example, a fin and round tube heat exchange coil or a fin and flat mini-channel tube heat exchanger. In the depicted embodiment, a variable speed motor 46 powered by a variable frequency drive 48 drives the fan(s) 44 associated with the heat rejection heat exchanger 40.

When the refrigeration system 20 operates in a transcritical cycle, the pressure of the refrigerant discharging from the second compression stage 30*b* and passing through the heat rejector 40, referred to herein as the high side pressure, exceeds the critical point of the refrigerant, and the heat rejector 40 functions as a gas cooler. However, it should be understood that if the refrigeration system 20 operates solely in the subcritical cycle, the pressure of the refrigerant discharging from the compressor and passing through the heat rejector 40 is below the critical point of the refrigerant, and the heat rejector 40 functions as a condenser. As the method of operation disclosed herein pertains to operation of the refrigeration system 20 in a transcritical cycle, the heat rejector will also be referred to herein as gas cooler 40.

The evaporator 50 may also comprise a finned tube coil heat exchanger 52, such as a fin and round tube heat exchanger or a fin and flat, mini-channel tube heat exchanger. Whether the refrigeration system is operating in a transcritical cycle or a subcritical cycle, the evaporator 50 functions as a refrigerant evaporator. Before entering the evaporator 50, the refrigerant passing through refrigerant line 24 traverses the evaporator expansion valve 55, such as, for example, an electronic expansion valve or a thermostatic expansion valve, and expands to a lower pressure and a lower temperature to enter heat exchanger 52. As the liquid refrigerant traverses the heat exchanger 52, the liquid refrigerant passes in heat exchange relationship with a heating fluid whereby the liquid refrigerant is evaporated and typically superheated to a desired degree. The low pressure vapor refrigerant leaving heat exchanger 52 passes through refrigerant line 26 to the suction inlet of the first compression stage 30*a*. The heating fluid may be air drawn by an associated fan(s) 54 from a climate controlled environment, such as a perishable/frozen cargo storage zone associated with a transport refrigeration unit, or a food display or storage area of a commercial establishment, or a building comfort zone associated with an air conditioning system, to be cooled, and generally also dehumidified, and thence returned to a climate controlled environment.

The flash tank 60, which is disposed in refrigerant line 24 between the gas cooler 40 and the evaporator 50, upstream of the evaporator expansion valve 55 and downstream of the high pressure expansion valve 45, functions as an economizer and a receiver. The flash tank 60 defines a chamber 62 into which expanded refrigerant having traversed the high pressure expansion device 45 enters and separates into a liquid refrigerant portion and a vapor refrigerant portion. The liquid refrigerant collects in the chamber 62 and is metered therefrom through the downstream leg of refrigerant line 24 by the evaporator expansion valve 55 to flow through the evaporator 50.

The vapor refrigerant collects in the chamber 62 above the liquid refrigerant and may pass therefrom through economizer vapor line 64 for injection of refrigerant vapor into an intermediate stage of the compression process. An economizer flow control device or valve 65, such as, for example, a solenoid valve (ESV) having an open position and a closed position, is interposed in the economizer vapor line 64. When the refrigeration system 20 is operating in an economized mode, the economizer flow control device 65 is opened thereby allowing refrigerant vapor to pass through the economizer vapor line 64 from the flash tank 60 into an intermediate stage of the compression process. When the refrigeration system 20 is operating in a standard, non-economized mode, the economizer flow control device 65 is closed thereby preventing refrigerant vapor to pass through the economizer vapor line 64 from the flash tank 60 into an intermediate stage of the compression process.

In an embodiment where the compressor 30 has two compressors connected in serial flow relationship by a refrigerant line, one being a first compression stage 30*a* and the other being a second compression stage 30*b*, the vapor injection line 64 communicates with refrigerant line interconnecting the outlet of the first compression stage 30*a* to the inlet of the second compression stage 30*b*. In an embodiment where the compressor 30 comprises a single compressor having a first compression stage 30*a* feeding a second compression stage 30*b*, the refrigerant vapor injection line 64 may open directly into an intermediate stage of the compression process through a dedicated port opening into the compression chamber.

The refrigeration system 20 also includes a controller 100 operatively associated with the plurality of flow control valves 45, 55 and 65 interdisposed in various refrigerant lines as previously described. As in conventional practice, in addition to monitoring ambient air temperature ($T_{amb}$), supply box air ($T_{SBAIR}$), and return box air ($T_{RBAIR}$), the controller 100 also monitors various pressures and temperatures and operating parameters by means of various sensors operatively associated with the controller 100 and disposed at selected locations throughout the refrigeration system 20. For example, a pressure sensor 102 may be disposed in association with the compressor 30 for measuring pressure discharge ($P_d$), or may be disposed in association with the gas cooler 40 to sense the pressure of the refrigerant at the outlet of the heat exchanger coil 42 of the gas cooler 40, which pressure is equivalent to ($P_d$); a temperature sensor 104 may be disposed in association with the gas cooler 40 to measure the temperature ($T_{gc}$) of the refrigerant leaving the heat exchange coil 42 of the gas cooler 40; a temperature sensor 106 may be disposed in association with the evaporator 50 to sense the temperature ($T_{EVAPout}$) of the refrigerant leaving the heat exchanger 52 of the evaporator 50; and a pressure sensor 108 may be disposed in association with the suction inlet of the first compression stage 30*a* to sense the pressure ($P_s$) of the refrigerant feeding to the first compression stage 30*a*. The pressure sensors 102 and 108 may be conventional pressure sensors, such as for example, pressure transducers, and the temperature sensors 104 and 106 may be conventional temperature sensors, such as for example, thermocouples or thermistors.

The term "controller" as used herein refers to any method or system for controlling and should be understood to encompass microprocessors, microcontrollers, programmed digital signal processors, integrated circuits, computer hardware, computer software, electrical circuits, application specific integrated circuits, programmable logic devices, programmable gate arrays, programmable array logic, personal computers, chips, and any other combination of discrete analog, digital, or programmable components, or other devices capable of providing processing functions.

The controller 100 is configured to control operation of the refrigeration system 20 in various operational modes, including several capacity modes. A capacity mode is a system operating mode wherein a refrigeration load is imposed on the system requiring the compressor to run in a loaded condition to meet the cooling demand. In an unloaded mode, the cooling demand imposed upon the system is so low that sufficient cooling capacity may be generated to meet the cooling demand with the compressor 30 running in an unloaded condition. The controller 100 is also configured to control the variable speed drive 34 to vary the frequency of electric current delivered to the compressor drive motor so as to vary the speed of the compressor 30 in response to capacity demand.

As noted previously, in transport refrigeration applicants, the refrigeration system 20 must be capable of operating at high capacity to rapidly pulldown the temperature within the cargo box upon loading and must be capable of operating at extremely low capacity during maintenance of the box temperature within a very narrow band, such as for example as little as +/−0.25° C. (+/−0.45° F.), during transport. Depending upon the particular cargo being shipped, the required box air temperature may range from as low as −34.4° C. (−30° F.) up to 30° C. (86° F.). Thus, the controller 100 will selectively operate the refrigeration system in response to a cooling capacity demand, such as during initial pulldown and recovery pulldowns, in an economized perishable mode or a standard non-economized perishable mode for non-frozen perishable products, and in an economized frozen mode or a standard non-economized frozen mode for frozen products.

The controller 100 may also selectively operate the refrigeration system 20 in an unload mode when maintaining the box temperature in a narrow band around a set point box temperature. Typically, the box temperature is controlled indirectly through monitoring and set point control of one or both of the temperature ($T_{SBAIR}$), of the supply box air, (i.e., the air exiting the evaporator 50), and the temperature ($T_{RBAIR}$), of the return box air (i.e., the air entering the evaporator 50).

Although not illustrated, the refrigeration system 20 may further include an intercooler as part of the air cooler 40 and which is disposed in the primary refrigerant circuit between the discharge outlet of the first compression stage 30*a* and the inlet to the second compression stage 30*b* whereby the partially compressed (intermediate pressure) refrigerant vapor (gas) passing from the discharge outlet of the first compression stage 30*a* to the inlet to the second compression stage 30*b* passes in heat exchange relationship with a flow of cooling media, such as, for example, but not limited to the cooling air flow generated by the gas cooler fan 44.

Because transcritical refrigeration systems 20 operate at high pressures often ranging from about 1000 psia to 1800 psia for significant amounts of time, the risk of refrigerant leakage may be higher than low pressure refrigeration systems. A loss of refrigerant may cause a loss of cooling which could increase the risk of cargo damage. The present disclosure provides a method to detect a loss of charge (i.e., refrigerant leakage) before the refrigeration system suffers significant cooling loss, thus providing time to correct the condition before damage to cargo results.

A real-time air side temperature difference ($dT_a$) (i.e., $T_{RBAIR}-T_{SBAIR}$) across the evaporator 50 may be determined by several variables and parameters as set forth below and regardless of system operating mode:

$$dT_a=f(T_{amb},T_{box},\text{rpm_comp},\text{rpm_evapfan},M\text{charge}) \quad (1)$$

Where ($T_{amb}$) is the ambient temperature, ($T_{box}$) is cargo box temperature, (rpm_comp) is the compressor speed, (rpm_evapfan) is the evaporator fan speed, ($M_{charge}$) is refrigerant charge.

The air side temperature difference ($dT_a$) may thus generally be expressed as a function of the ambient temperature ($T_{amb}$), the box temperature ($T_{box}$), the compressor speed (rpm_comp), evaporator fan speed (rpm_evapfan), and the refrigerant charge ($M_{charge}$). Because of difficulties, time and expense in establishing an equation form through purely theoretical analysis, a method curve fit may be applied. A number of simulation runs make it possible to employ more efficient theoretical mathematical models to do such an optimization, compared to realizing the equation form purely by means of extensive experimental tests.

The model is then run at various conditions selected so as to cover the typical operation range of the refrigeration product. By running at the prescribed conditions, the air side temperature difference ($dT_a$) as well as the ambient temperature ($T_{amb}$), the box temperature ($T_{box}$), the compressor speed (rpm), evaporator fan speed (rpm_evapfan), and refrigerant charge ($M_{charge}$) can be determined for each condition. When all conditions are completed, a map (i.e., T-Map) of air side temperature difference versus ambient temperature, box temperature, compressor speed, evaporator fan speed and refrigerant charge may be created. A curve-fit may then be established based on the map to obtain a correlation of the air side temperature difference. Such a correlation may be a second order polynomial equation.

For example, two T-Maps may be generated, see FIG. 3. The first T-Map may be representative of normal refrigeration system 20 operation (T-Map Normal). The second T-Map may be representative of a loss of charge condition (T-Map Charge Loss). For both conditions, a second order polynomial equation may be sufficiently accurate to estimate the air side temperature difference ($dT_a$) at each compressor speed correction (from minimal frequency to maximal frequency), then air side temperature difference ($dT_a$) at any other speeds may be obtained through interpolation. The second order polynomial equation may be:

$$dT_a=CF_{evapfan}*[a_0+a_1(T_{amb})+a_2(T_{box})+a_3(T_{amb})^2+a_4(T_{box})^2+a_5(T_{amb}\times T_{box})] \quad (2)$$

Where ($CF_{evapfan}$) is the correction factor based on the evaporator fan speed, is the function of evaporator fan speed ratio (Evaporator Fan Speed/Maximal Evaporator Fan Speed). Where $a_0$, $a_1$, $a_2$, $a_4$, $a_5$ are constants.

To establish an acceptable level of confidence, conditions under which a loss of charge can be detected may be established, thus avoiding false detections. Generally, a loss of charge may be detected with a higher level of confidence during high capacity operation conditions of the refrigeration system 20, rather than low operation conditions. Moreover, simulations have shown that T-Map prediction has higher accuracy in high capacity operation as well. Thus to define the detection time window when the loss of charge detection is triggered a few rules may be established. Such rules may include:

a) Compressor speed or VFD: Higher compressor speed represents higher cooling capacity. To trigger on the loss of charge detection, the compressor 30 speed may need to be larger than a predefined speed.

b) Air side temperature difference under normal charge condition (i.e., T-Map Normal): To trigger on the loss of charge detection, the air side temperature difference calculated by T-Map Normal should be more than a predefined value.

c) Time Pulldown is run: The T-Map functions are curve-fit based steady state simulation results, thus are not applicable or inaccurate for startup and initial pulldown period when system is operated under high dynamics. The loss of charge detection should be started on certain time after startup and initial pulldown.

Figure 4:
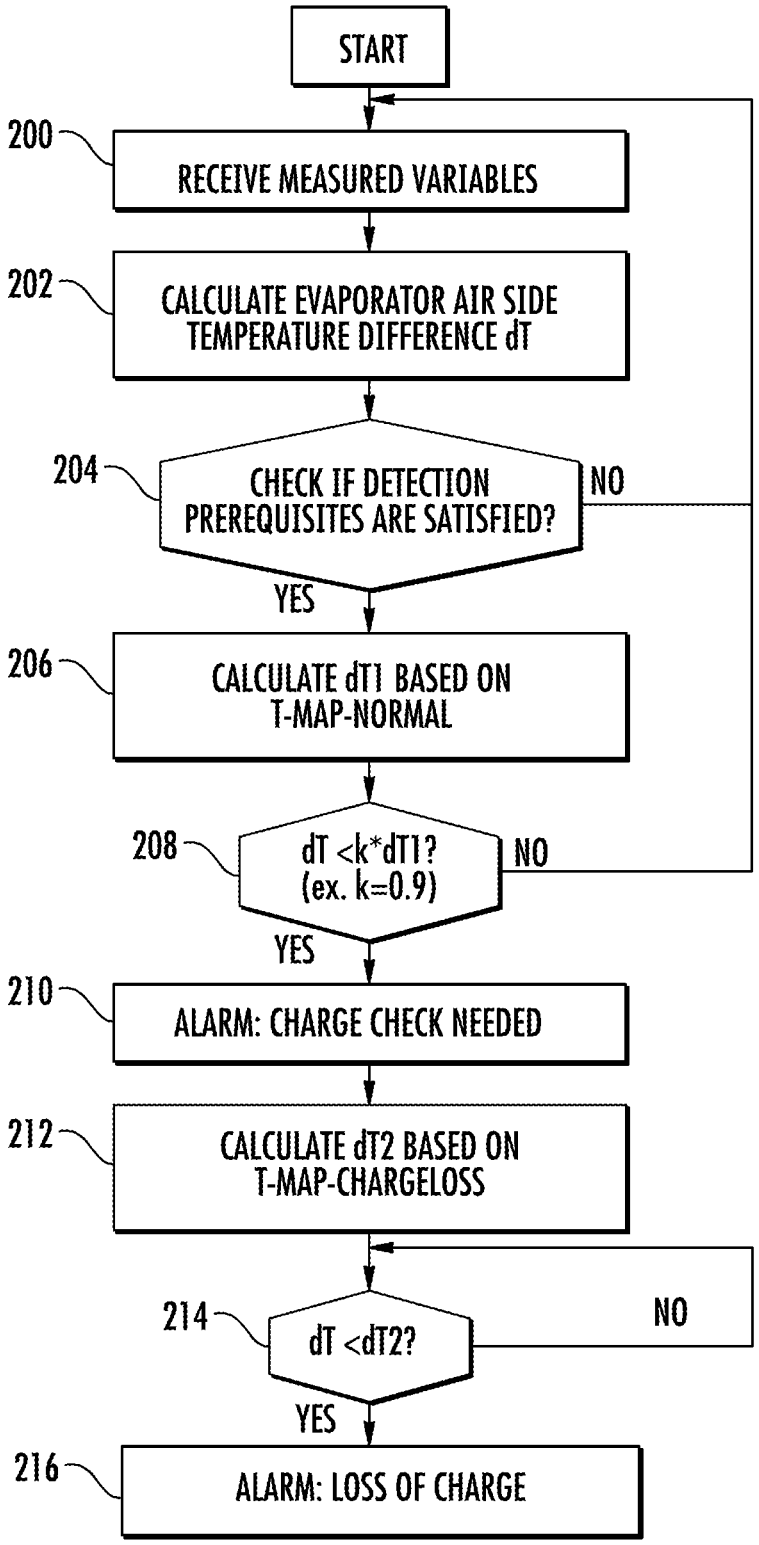
FIG. 4 is a flow chart of a method of determining charge loss of the refrigeration system.

Referring to FIG. 4, a loss of charge detection algorithm may be preprogrammed into the controller 100 utilizing the T-Maps as previously discussed. For example, a loss of charge detection method may include the controller 100 receiving the measured variables such as: the box temperature ($T_{box}$), the compressor speed (rpm), evaporator fan speed (rpm_evapfan), and refrigerant charge ($M_{charge}$), charge), as step 200. For step 202, the controller 100 may calculate a air side temperature difference ($dT_a$) based on measured supply/return air temperature, As step 204, the controller may check if detection prerequisites are satisfied. If "No," the method returns to step 200, if "Yes," the method advances to step 206. As step 206, the controller calculate the first air side temperature difference (dT1) based on pre-programed T-Map Normal and equation (1). As step 208, the controller 100 compares the measured air side temperature difference (dT) and the first calculated air side temperature difference (dT1). If the measured air side temperature difference is not less than the first air side temperature difference multiply a correction factor k, for example 0.9, the method returns to step 200. Otherwise the method moves to step 210 to trigger a charge check alarm. As step 212, the controller calculates a second air side temperature difference based on a pre-programed T-Map Charge Loss and equation (1). As step 214, the controller 100 compares the measured air side temperature difference and second air side temperature differences. If the measured air side temperature difference is not less than the second air side temperature difference the method returns to step 212. If the measured air side temperature difference is less than the second air side temperature difference the method advance to step 216. As step 216, the controller 100 may initiate an alarm signifying a loss of charge.

While the present disclosure is described with reference to exemplary embodiments, it will be understood by those skilled in the art that various changes may be made and equivalents may be substituted without departing from the spirit and scope of the present disclosure. In addition, various modifications may be applied to adapt the teachings of the present disclosure to particular situations, applications, and/or materials, without departing from the essential scope thereof. The present disclosure is thus not limited to the particular examples disclosed herein, but includes all embodiments falling within the scope of the appended claims.

What is claimed is:

1. A method of determining charge loss of a refrigeration system comprising:

inputting a supply air temperature, a return air temperature, an ambient temperature, a box temperature, and a compressor speed into an electronic controller of the refrigeration system;

measuring a real-time air side temperature difference across an evaporator;

calculating a first air side temperature difference across the evaporator by applying an algorithm having a first T-Map representative of normal operating conditions;

confirming a detection prerequisite is satisfied;

calculating a second air side temperature difference across the evaporator by applying the algorithm having a second T-Map representative of a loss of refrigerant charge;

taking a first action if the real-time air side temperature difference is less than the first air side temperature difference; and taking a second action if the real-time air side temperature difference is less than the second air side temperature difference.

2. The method set forth in claim 1 further comprising:

inputting an evaporator multi-speed fan speed.

3. The method set forth in claim 1, wherein the algorithm applies a polynomial.

4. The method set forth in claim 3, wherein the first and second T-Maps are pre-programmed into the controller and provide a curve fit of a plurality of constants versus compressor speed.

5. The method set forth in claim 4, wherein the plurality of constants are six constants applied to ambient temperature and box temperature variables as part of the polynomial.

6. The method set forth in claim 1, wherein the detection prerequisite is a measured compressor speed being greater than a predefined compressor speed.

7. The method set forth in claim 1, wherein the detection prerequisite is the first air side temperature difference being greater than a predefined temperature difference.

8. The method set forth in claim 1, wherein the detection prerequisite is that the first air side temperature difference is determined after a predefined time span from initial system startup and initial pulldown.

9. The method set forth in claim 1, wherein the detection prerequisite is one of a plurality of detection prerequisites and at least includes a measured compressor speed being greater than a predefined compressor speed, the first air side temperature difference being greater than a predefined temperature difference, and the first air side temperature difference is determined after a predefined time span from initial system startup and initial pulldown.

10. The method set forth in claim 1, wherein the first and second T-Maps are representative of evaporator air side temperature difference versus ambient temperature, box temperature, compressor speed and refrigerant charge.

11. The method set forth in claim 1, wherein the refrigeration system is a transcritical refrigeration system.

12. The method set forth in claim 1 further comprising:

inputting an evaporator variable speed fan speed.

13. A refrigeration system comprising:

an electronic controller including, pre-programmed first and second T-Maps both representative of evaporator air side temperature difference versus ambient temperature, box temperature, compressor speed and refrigerant charge operating conditions, and wherein the first T-Map is representative of normal operating conditions and the second T-Map is representative of a loss of refrigerant charge, and pre-programmed prerequisites configured to be met prior to initiating an action based on a loss of refrigerant charge; and wherein the electronic controller is configured to calculate first and second evaporator air side temperatures based on the respective first and second T-maps and initiates an action if the first air side temperature difference is less than the second air side temperature difference.

14. The refrigeration system set forth in claim 13, wherein the refrigeration system is a transcritical refrigeration system.

15. The refrigeration system set forth in claim 14, wherein the refrigerant is CO2.

* * * * *